United States Patent [19]

Uchida et al.

[11] 4,380,917

[45] Apr. 26, 1983

[54] TUBE-BENDING MACHINE

[75] Inventors: Fumihiko Uchida, Koganei; Kazuo Sato; Soji Takahashi, both of Hachioji, all of Japan

[73] Assignee: Hitachi, Ltd., Tokyo, Japan

[21] Appl. No.: 231,922

[22] Filed: Feb. 5, 1981

[30] Foreign Application Priority Data

Feb. 22, 1980 [JP] Japan ..... 55-20521

[51] Int. Cl.[3] ..... B21D 9/05

[52] U.S. Cl. ..... 72/8; 72/32; 72/150

[58] Field of Search ..... 72/8, 21, 28, 32, 41, 72/42, 43, 44, 45, 150, 370

[56] References Cited

U.S. PATENT DOCUMENTS

| | | | |
|---|---|---|---|
| 3,352,136 | 11/1967 | Clarke | 72/9 |
| 3,670,541 | 6/1972 | Peddinghaus | 72/8 |
| 3,798,943 | 3/1974 | Benteler et al. | 72/43 |
| 3,899,908 | 8/1975 | Somov et al. | 72/28 |
| 4,190,887 | 2/1980 | Yoshiwara et al. | 72/8 X |

FOREIGN PATENT DOCUMENTS

| | | | |
|---|---|---|---|
| 736862 | 6/1943 | Fed. Rep. of Germany | 72/44 |
| 1442832 | 5/1966 | France | 72/150 |
| 41-18214 | 10/1966 | Japan | 72/150 |
| 377142 | 7/1932 | United Kingdom | 72/150 |
| 320095 | 11/1971 | U.S.S.R. | 72/150 |

*Primary Examiner*—Ervin M. Combs

*Attorney, Agent, or Firm*—Antonelli, Terry & Wands

[57] ABSTRACT

This invention relates to a tube-bending machine, which is so constructed that force detection means to detect a force acting in the axial direction of a mandrel under a tube-bending operation is disposed on the mandrel of tube-bending means so as to sense bending conditions such as a lubrication condition of an inner surface of a tube being bent and a mandrel position, and further that fluctuations from predetermined bending conditions, of the bending conditions during the tube-bending operation are detected and corrected.

9 Claims, 8 Drawing Figures

TUBE-BENDING MACHINE

BACKGROUND OF THE INVENTION

This invention relates to improvements in a tube-bending machine which performs the bending of a tube or pipe with a mandrel inserted in the tube.

Problems which occur during tube bending with the tube-bending machine of the type specified above includes rupturing of the tube being bent as is ascribable to an insufficient lubrication of the inner surface of the tube, and the appearance of wrinkles on the inner side of the tube bend, the distortion of a tube section or the thinning of the outer side of the tube bend as is attributed to a deviation in the optimum mandrel position.

FIG. 1 is a view for explaining a case of resorting to the radial-draw bending as a typical example of the tube-bending machine (refer to Journal of Mechanical Working Technology, 3 (1979) 151'166). Referring to the figure, a mandrel 1 is inserted into a tube 2, the tube is clamped to a bend die 4 by a clamp die 3, and the bend die 4 is thereafter rotated a predetermined angle, whereby the radial-draw bending machine bends the tube. In the figure, numeral 11 indicates a wiper die and numeral 12 a pressure die, between which the tube 2 is movably supported. With the prior-art tube-bending machine, however, variations in the lubrication condition of the tube and the setting position of the mandrel cannot be detected during the working, and hence, the worked products must be inspected. This leads to the disadvantage of an inferior available percentage of the products.

SUMMARY OF THE INVENTION

This invention has been made with note taken of the above point, and has for its object to provide a tube-bending machine in which fluctuations in the lubrication condition of the inner surface of a tube, the setting position of a mandrel, etc. as stated above are detected during the bending of the tube and which permits the control of the bending condition of the tube and the automation thereof.

In order to accomplish the object, a tube-bending machine according to this invention comprises a mandrel, means to bend a tube with said mandrel inserted in said tube, and means to detect a force acting in an axial direction of said mandrel under the tube bending, so as to sense a bending condition of said tube.

DETAILED DESCRIPTION OF THE PREFERRED EMBODIMENTS

Hereunder, this invention will be described with reference to embodiments.

The inventors have found out that, as will be explained later, a force in the axial direction of a mandrel is very susceptible to a bending condition and exhibits a characteristic variation in dependence on the lubrication condition, the variation of the setting position of the mandrel or the appearance of wrinkles. This invention has been made on the basis of such new knowledge, and records a master curve under a predetermined or optimum bending condition in advance, thereby to realize the control of the bending condition during the bending and the automation thereof.

Figure 1:
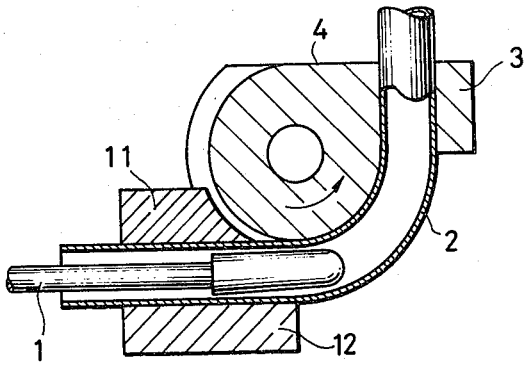
FIG. 1 is a view for explaining an example of a prior-art tube-bending machine.
Figure 2:
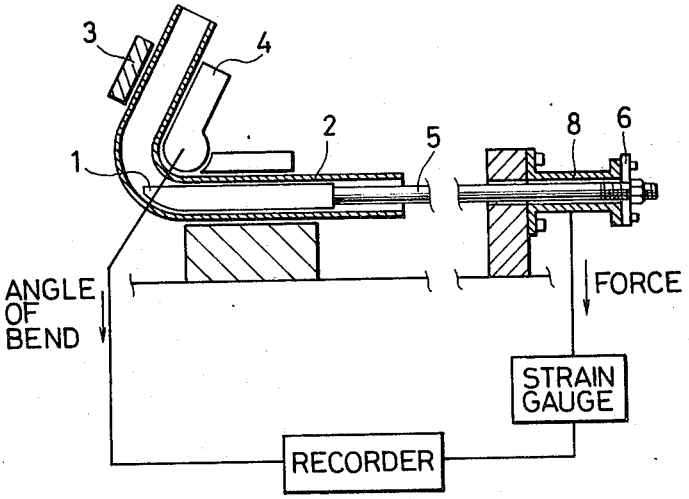
FIG. 2 is a view for explaining an example of a tube-bending machine according to this invention.

FIG. 2 shows an example of a tube-bending machine according to this invention. Referring to the figure, the example is a radial-draw bending machine in which a tube 2 has a mandrel 1 inserted therein and is clamped to a bend die 4 by a clamp die 3, whereupon the bend die 4 is rotated a predetermined angle thereby to bend the tube. An axial force which acts on the mandrel 1 during the tube bending is transmitted to a load cell 8 which is fixed to a mandrel pedestal 7 by means of a nut 6 fixed to a mandrel bar 5. A force signal detected by the load cell 8 is passed through a strain gauge 9, and is displayed on a recorder 10 as a load curve versus the angle of bend.

Figure 3:
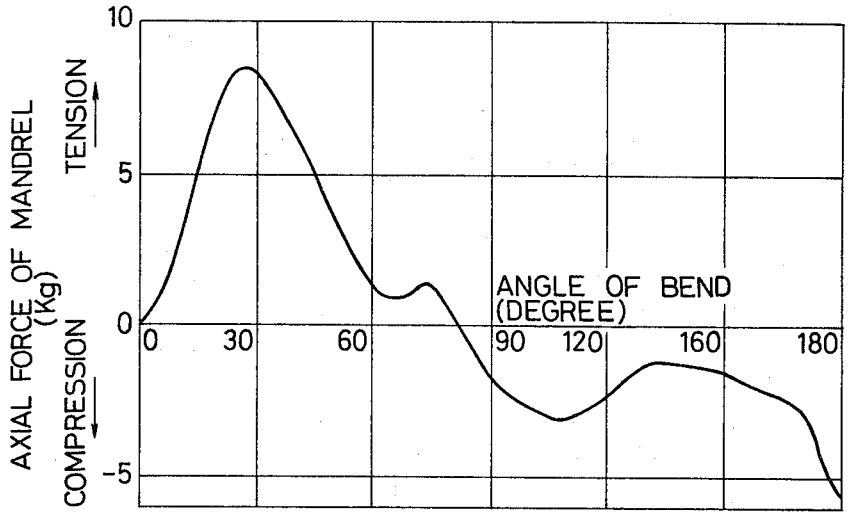
FIG. 3 is a characteristic diagram showing an example of the master curve of an axial force of mandrel-versus-angle of bend curve.

FIG. 3 shows an example of the master curve of the load curve under the optimum bending condition in the case of using the spoon mandrel as shown in FIG. 2. In FIG. 3, the axis of abscissas represents the angle of bend of the axis of a tube with respect to the axis of a mandrel on the clamp side, while the axis of ordinates represents the axial force of the mandrel. It is known from the figure that the tension force acting on the mandrel axis presents a peak near an angle of bend of 30° and thereafter decreases, and that the compression force is exhibited after an angle of bend of 80°. While master curves present respectively characteristic forms in dependence on mandrels used, the spoon mandrel will be taken as an example here and the influences of a lubricant and the mandrel setting position on the master curve will be stated hereunder. The material of the tube used is phosphorus-deoxidized copper (Cu: 99.97%, P: 0.02%), and the starting tube has an outside diameter of 9.53 mm and a wall thickness of 0.35 mm. In addition, the radius of bend is 12.5 mm.

Figure 4:
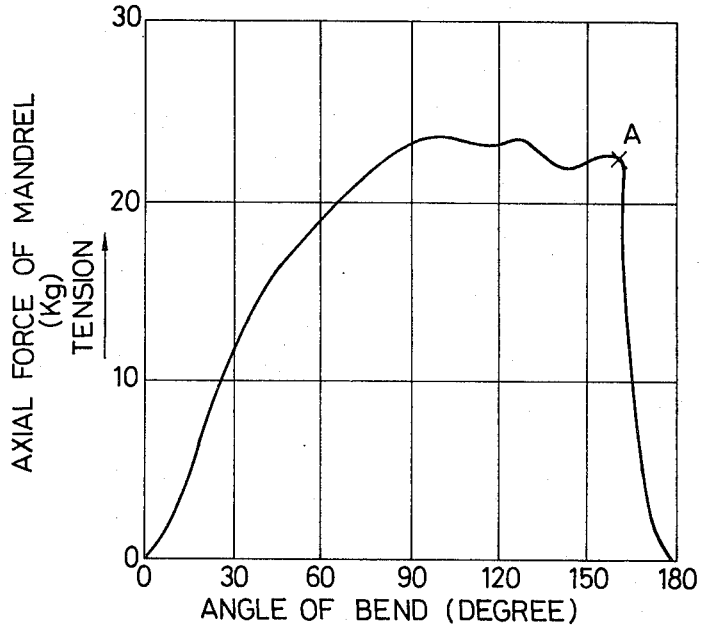
FIG. 4 is a characteristic diagram showing a load curve in the case where the lubrication of the inner surface of a tube is made insufficient.

FIG. 4 shows a load curve in the case where the lubrication of the inner surface of the tube is made insufficient. The aspect of the curve differs conspicuously, and a great tension force develops. The rupture of the tube is sensed at a point A in the figure.

Figure 5:
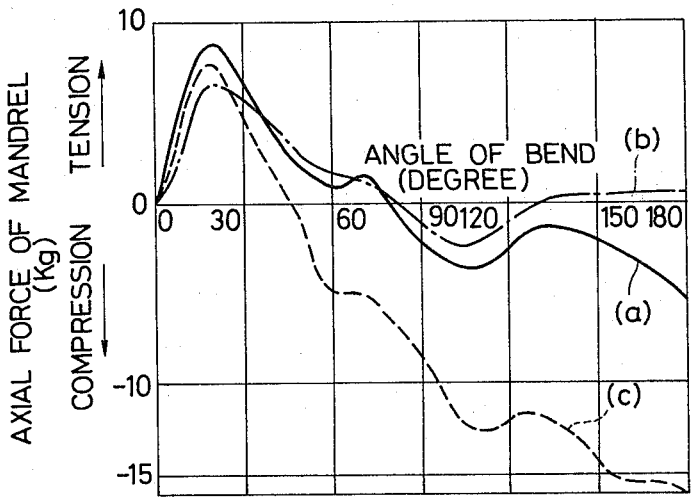
FIG. 5 is a characteristic diagram showing a load curve in the case where the setting position of a mandrel is changed.

FIG. 5 shows the variations of a load curve dependent upon the mandrel setting position. When the mandrel is slightly drawn backward in the axial direction, the load curve becomes a curve (b) in which the compression force shifts onto the decreasing side thereof as compared with that of the master curve (a), whereas when the mandrel is slightly pushed forward, the load curve becomes a curve (c) in which the compression force shifts onto the increasing side thereof.

Figure 6:
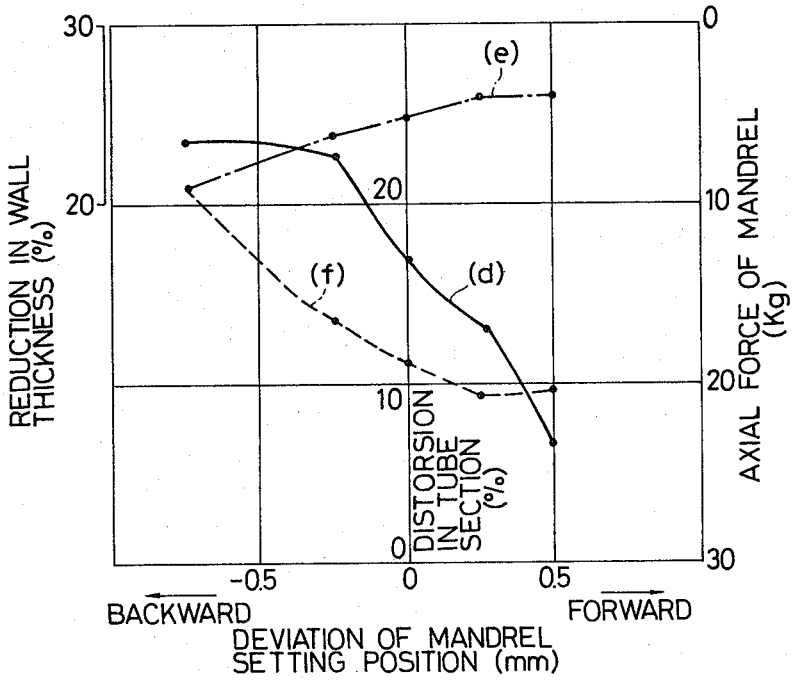
FIG. 6 is a characteristic diagram showing the relationships of the deviation of a mandrel setting position with the axial compression force of a mandrel, the reduction of a wall thickness on the outer side of a tube bend, and the distortion of a tube section.

FIG. 6 shows the axial compression force (d), the reduction of a wall thickness (e) on the outermost side of a tube bend and the distortion of a tube section (f) in the case of an angle of bend of 180° as are plotted versus the deviation of a setting position. The reduction of a wall thickness indicates in percentage a value obtained in such a way that a decrement in the wall thickness on the outermost side of the bend, with respect to the wall thickness of the starting tube is divided by the wall thickness of the starting tube, while the distortion of a tube section indicates in percentage a value obtained in such a way that the difference between the major diameter and the minor diameter of the tube section in the middle of the bent portion is divided by the diameter of the starting tube. As apparent from the figure, when the mandrel setting position is shifted onto the backward side, the reduction in the wall thickness decreases, whereas the distortion in the tube section increases. Conversely, when the mandrel setting position is pushed forward, the distortion in the tube section decreases, whereas the reduction in the wall thickness increases. Beyond a forward deviation of 0.25 mm, however, both the reduction in the wall thickness and the distortion in the tube section tend to become substantially constant values. In contrast, the magnitude of the axial compression force becomes greater as the setting position is moved from the backward side onto the forward side more. From the foregoing, it is understood that the reduction of the wall thickness and the distortion of the section of the tube vary depending upon the setting position and that they can be controlled by detecting the axial compression force of the mandrel.

Figure 7:
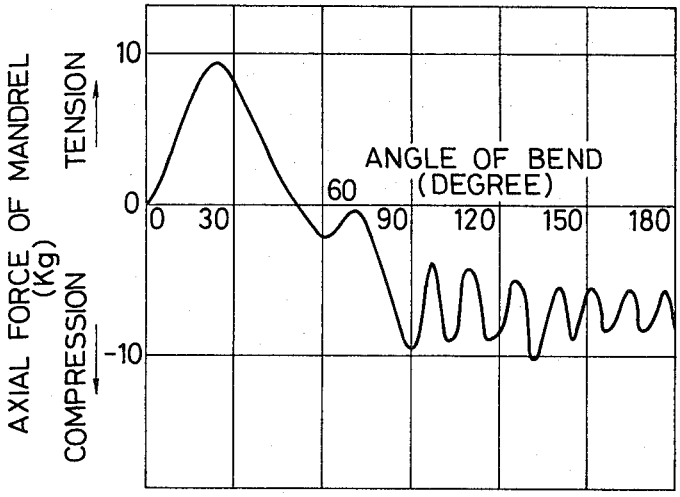
FIG. 7 is a characteristic diagram showing a load curve in the case where wrinkles have appeared on the inner side of a tube bend.

FIG. 7 shows a curve of loads acting on the mandrel at the time when wrinkles have appeared on the inner side of the tube bend. Upon the appearance of the wrinkles, the load curve varies wavily. It has also been confirmed that the number of the final wrinkles agrees with the number of the waves of the load curve.

As described above, the force acting in the axial direction of the mandrel is very susceptible to fluctuations from the optimum conditions of the tube bending, and the automation of the control of the bending conditions is permitted by exploiting this fact.

Figure 8:
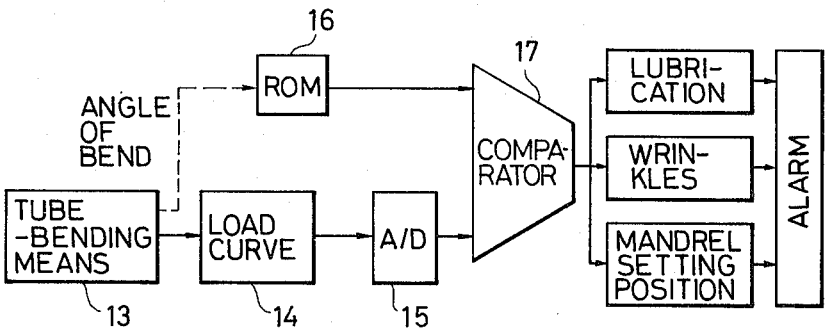
FIG. 8 is a diagram for explaining an example of the automation of the control of tube bending conditions.

FIG. 8 is a block diagram which shows an example of the automation of the bending condition control according to this invention. A load curve 14 obtained from tube-bending means 13 during the tube bending is converted by an analog-to-digital converter 15 into a digital value, which is compared with the value of a master curve stored in a ROM (read-only memory) 16 by the use of a digital comparator 17. In case where a greater tension has been detected in the load curve than in the master curve, an alarm of an insufficient lubrication is issued; in case where the maximum compression force has suddenly changed, an alarm of a deviation in the mandrel setting position is issued; and in case where the load curve has varied wavily, an alarm of the appearance of wrinkles is issued. The fluctuation from the optimum bending condition as obtained from the detected result is fed back to the tube-bending means, to correct the lubrication or the mandrel position to the optimum condition. In this case, such correction may be made for the tube itself in real time or may well be made for a tube to be subsequently bent.

As set forth above, the deviation during the bending from the optimum bending condition is sensed by detecting the force acting in the axial direction of the mandrel, and it is fed back, whereby the control of the tube bending condition and the automation thereof become possible. While the radial-draw bending which employs the spoon mandrel has been described here, this invention is also applicable to mandrels in other shapes, for example, flexible ball mandrels such as single-ball mandrel and multi-ball mandrel, etc. and to other tube bending methods, for example, the tube compression bending, the eccentric plug bending, etc. On the other hand, regarding the automation of the bending condition control, the aspect described here is a mere example, and needless to say, various procedures are possible on the basis of the fundamental principle of the present invention that the signal of the force loaded in the axial direction of the mandrel in the course of the bending is detected.

While, in the foregoing embodiments, one example of the master curve indicative of the optimum bending condition has been referred to, it goes without saying that the present invention is not restricted thereto but that the master curve can be appropriately set depending upon a desired bending condition. Furthermore, this invention is not restricted to the concrete numerical values, materials etc. referred to in the foregoing examples, but it can appropriately select and set them depending upon a desired bending condition. In addition, while in the foregoing embodiments this invention has been described with the subject at U-tubes for use in heat exchangers etc., it is not restricted thereto but it has wide applications through proper settings of the angle of bend, etc. and is greatly effective in practical use.

What is claimed is:

1. A tube-bending machine comprising:

a mandrel, bending means to bend a tube with said mandrel inserted in said tube, and force detection means for detecting a force acting on said mandrel in an axial direction of said mandrel during bending of the tube by said bending means, so as to sense a bending condition of said tube.

2. A tube-bending machine according to claim 1, further comprising means to detect a fluctuation from a predetermined bending condition, of the bending condition of said tube detected in accordance with said force detection means and to correct the fluctuation.

3. A tube-bending machine according to claim 1, further comprising means to detect a lubrication condition of an inner surface of said tube and a position of said mandrel as a function of the force acting in the axial direction of said mandrel during bending of the tube by said bending means as detected by said force detection means and to correct the lubrication condition and the mandrel position to a predetermined condition and position.

4. A tube-bending machine according to claim 1, 2 or 3, wherein said bending means is a radial-draw bending mechanism.

5. A tube-bending machine according to claim 4, wherein said force detection means is a load cell.

6. A tube-bending machine according to claim 4, wherein said mandrel is a spoon mandrel.

7. A tube-bending machine according to claim 4, wherein said mandrel is a flexible ball mandrel.

8. A tube-bending machine according to claim 1 or 2, wherein said force detection means comprises support means for supporting said mandrel relative to said bending means and sensing means directly associated with said support means for sensing axial displacement forces exerted by said mandrel upon said support means as a result of the axial force acting on the mandrel during bending.

9. A tube-bending machine according to claim 8, wherein said support means comprises a mandrel pedestal, said mandrel being connected to said mandrel pedestal by means of a load cell.

* * * * *